US007621249B2

(12) United States Patent
Wallis et al.

(10) Patent No.: US 7,621,249 B2
(45) Date of Patent: Nov. 24, 2009

(54) PORT SEALING IN A ROTARY VALVE

(75) Inventors: Anthony Bruce Wallis, Gladesville (AU); Andrew Donald Thomas, North Epping (AU)

(73) Assignee: Bishop Innovation Limited, North Ryde, New South Wales (AU)

( * ) Notice: Subject to any disclaimer, the term of this patent is extended or adjusted under 35 U.S.C. 154(b) by 0 days.

(21) Appl. No.: 11/659,695

(22) PCT Filed: Aug. 31, 2005

(86) PCT No.: PCT/AU2005/001311

§ 371 (c)(1),
(2), (4) Date: Feb. 8, 2007

(87) PCT Pub. No.: WO2006/024086

PCT Pub. Date: Mar. 9, 2006

(65) Prior Publication Data

US 2008/0072866 A1 Mar. 27, 2008

(30) Foreign Application Priority Data

Sep. 1, 2004 (AU) ..... 2004904984

(51) Int. Cl.
*F01L 7/16* (2006.01)

(52) U.S. Cl. ..... 123/190.17; 123/80 BA; 123/190.8

(58) Field of Classification Search ..... 123/59.1, 123/80 R, 80 BA, 190.1, 190.8, 190.17
See application file for complete search history.

(56) References Cited

U.S. PATENT DOCUMENTS

| | | | | |
|---|---|---|---|---|
| 4,019,487 | A | 4/1977 | Guenther | |
| 4,022,178 | A * | 5/1977 | Cross et al. | 123/190.17 |
| 4,342,294 | A * | 8/1982 | Hopkins | 123/190.17 |
| 4,444,161 | A | 4/1984 | Williams | |
| 4,852,532 | A | 8/1989 | Bishop | |
| 5,154,147 | A * | 10/1992 | Muroki | 123/190.17 |
| 5,255,645 | A * | 10/1993 | Templeton | 123/190.17 |
| 5,503,124 | A | 4/1996 | Wallis | |
| 5,509,386 | A | 4/1996 | Wallis et al. | |
| 5,526,780 | A | 6/1996 | Wallis | |
| 5,941,206 | A | 8/1999 | Smith et al. | |
| 6,321,699 | B1 * | 11/2001 | Britton | 123/80 R |
| 6,578,538 | B2 * | 6/2003 | Trentham | 123/190.2 |
| 6,651,605 | B2 * | 11/2003 | Trentham | 123/190.8 |
| 2006/0185640 | A1 * | 8/2006 | Barnes | 123/190.8 |

* cited by examiner

*Primary Examiner*—Hai H Huynh
(74) *Attorney, Agent, or Firm*—Birch, Stewart, Kolasch & Birch, LLP

(57) ABSTRACT

An axial flow rotary valve (1) for an internal combustion engine comprising a cylinder head (10) having a bore in which an axial flow rotary valve (1) rotates. The valve having a cylindrical centre portion (4), and an inlet and an exhaust port (2, 3) terminating as openings (7, 8) in the centre portion, the openings periodically communicating with a combustion chamber (23) through a window (15) in the bore. The clearance between the centre portion and the bore being sealed by an array of floating seals comprising at least two axial seals (16*a*, 16*b*) spaced apart on opposite sides of the window. The assembly further comprising at least one floating axially extending masking seal (5) being disposed outside the window and circumferentially remote from the axial seals.

11 Claims, 6 Drawing Sheets

PORT SEALING IN A ROTARY VALVE

TECHNICAL FIELD

The present invention relates to a port sealing arrangement for a rotary valve assembly used in an internal combustion engine. In particular the port sealing arrangement is applicable to axial flow rotary valves that accommodate an inlet and an exhaust port in the same valve terminating as openings in the valve's periphery and run with small clearance to the bore in which the valve is housed.

BACKGROUND

During rotation of an axial flow rotary valve, openings in the periphery of the valve are arranged to periodically communicate with a similar window in the bore of the cylinder head that opens directly into the combustion chamber. Alignment between the openings and the window allows the passage of gas from the valve to the combustion chamber or vice versa. During a portion of the cycle when compression and combustion of gases takes place, the periphery of the valve blocks the window. The gas sealing system prevents the escape of high pressure gas during this portion of the cycle.

The valve is typically supported by bearings located either side of a centre portion of the valve in which the openings in the valve's periphery are located. The valve and its bearings are housed in a bore in the cylinder head in such a fashion as to ensure the centre portion can rotate whilst always maintaining a small radial clearance to the bore.

The bearings are lubricated with oil, and in some instances the valve is also cooled with oil that is pumped through the valve. An oil sealing system prevents the migration of oil into the area between the periphery of the centre portion of the valve and the bore in which the valve is housed.

Large numbers of rotary valve arrangements have been proposed but none have achieved commercial success. One of the major contributing factors to this lack of success is the failure to develop a satisfactory gas sealing arrangement.

Rotary valves that run with a small predetermined clearance to the cylinder head bore were developed to address the problem of thermal and mechanical deflection of the valve that had plagued rotary valve development for the most part of the 20th century. One of the first of these solutions is found in U.S. Pat. No. 4,852,532 (Bishop), in which the valve is designed to run with a small clearance to cylinder head bore and the combustion chamber is sealed by means of a floating array of seals arranged around the window in the cylinder head.

The existence of a small clearance between the periphery of the valve and the cylinder head bore enabled a small amount of thermal and mechanical distortion to occur without the periphery of the valve making contact with the bore. However, in valves with both inlet and exhaust ports in the same valve this means that these ports were not physically sealed from one another.

In these arrangements it is necessary to control the flow of gas between the ports—either the flow of exhaust gas from the exhaust port to the inlet port or the flow of inlet gas from the inlet port to the exhaust port. Flow of gas between the inlet and exhaust port was controlled by making the radial clearance between the valve and the cylinder head bore small. The combination of small clearances and small pressure differences between the inlet and exhaust ports limits the flow of gases between the ports. In most cases the pressure in the exhaust port is larger than the pressure in the inlet port, and consequently leakage is predominantly from the exhaust port into the inlet port. This sealing arrangement requires the use of valves that have minimal thermal and physical distortion. The smaller the distortion, the smaller the required radial clearance and the better the sealing between the inlet and exhaust ports.

In some instances the flow of a limited amount of gas between the ports is acceptable. In most engines a small amount of flow from the exhaust port into the inlet port is not a great concern as it merely contributes to a process that is often used to regulate emissions—ie internal egr (exhaust gas recirculation). However, in some instances such as high performance engines even a small amount of leakage between the exhaust port and the inlet port is a problem as this leakage reduces engine power.

Pressures in the exhaust and inlet ports are not constant over the duration of an engine cycle. The pressures in these ports undergo large cyclic variations during the engine cycle. For example in some engines, shortly after the exhaust opens, the exhaust port pressure rises rapidly above atmospheric pressure to over 1 bar. Later in the cycle the pressure may fall below atmospheric pressure. In high performance engines at full throttle and when the exhaust valve is closed, pressures in the exhaust port will vary sinusoidally as pressure waves traverse between the exhaust opening and the end of the exhaust pipe.

In the inlet port, the pressure will be pulled low early in the induction process and will rise above atmospheric pressure later in the induction process close to the point where the valve closes. When the inlet opening is closed pressure in the inlet port will vary sinusoidally as pressure waves traverse between the inlet opening and the end of the inlet tract. As a consequence, the pressure difference between the inlet and exhaust port is subject to rapid cyclic fluctuation through out the engine cycle.

In other instances, such as a production engine operating at idle, the amount of leakage between the exhaust port and the inlet port may be too great and adversely affect the smooth idle of the engine. In production engines having a throttle operating at idle, the pressure in the inlet port is maintained at a very low pressure, typically lower than 0.5 bar below atmospheric pressure (−0.5 bar gauge), over most of the engine cycle. The low engine speed at idle means there is a relatively long period of time for exhaust to leak across the bridge into the inlet port. The combination of high pressure difference and long time available for leakage means that in some instances excessive amounts of exhaust gas will leak into the inlet system.

The purpose of the present invention is to provide a mechanism that minimises the flow of gas from one port to another, and in particular during those portions of the cycle where there is a large pressure difference between the ports and where the resulting flows will create problems with the operation of the engine.

A typical example of where this is issue occurs is in high performance engines under full throttle. Because of the nature of these engines, they require larger radial clearances and are therefore more susceptible to adverse pressure drops between the ports. Under full throttle operation shortly after the exhaust port first opens the pressure in the exhaust port rises rapidly to well over 1 bar gauge. In arrangements like those in U.S. Pat. No. 4,852,532 (Bishop) this will result in the exhaust being pushed into the inlet port and a consequent loss of performance. Later in the cycle when the exhaust pressure drops below atmospheric, the transfer of exhaust gas to the inlet port is no longer a problem.

Another example occurs in engines operating under closed throttle conditions. During the induction stroke the cylinder and the inlet port are both pulled down to a very low pressure. If this occurs after the bridge between the inlet and exhaust port has passed over the trailing axial seal there is direct communication between the cylinder, the inlet port and the exhaust port through the gap that exists between the bridge and the bore in which the valve is housed. Exhaust will flow across the bridge into the inlet port driven by this high pressure drop between the ports.

The present invention is designed to work with a gas sealing system that consists of an array of floating seals positioned around the window and an oil sealing arrangement, both of which are disclosed in International Application PCT/AU2005/001306 published as WO 2006/024081 A1 (Bishop Innovation Limited) having the same priority date and applicant as the present invention. The present invention can however be adapted to work with other gas sealing arrangements having an array of floating seals such as the seal array disclosed in U.S. Pat. No. 5,509,386 (Wallis et al).

The closest known prior art is U.S. Pat. No. 5,941,206 (Smith et al). This patent applies to a different class of rotary valve than the present invention. However, the patent purports to solve the same problem that the present invention address, ie the problem of leakage between the ports in a rotary valve that maintains a clearance to the cylinder bore in which the valve is housed. It purports to solve this problem by fitting axial extending seals into the rotating valve and loading them against the cylinder head bore in which the valve is housed. In this arrangement axial extending seals are positioned between the ports thereby preventing any significant transfer of gas circumferentially directly between the ports irrespective of the pressure difference between the ports. However for reasons explained below it fails to prevent the transfer of gas between the ports and worse still it allows the combustion gases from the cylinder to leak into the ports and in the process fails to adequately seal the combustion chamber. Furthermore the type of arrangement disclosed has several other problems as follows.

Firstly, consider the sealing system. During combustion the high pressure trapped between an adjacent pair of axial extending seals and the circumferential seals will push the circumferential seals axially outward against the axially outer faces of the grooves in which the circumferential seals are housed. High pressure gas will be forced into the gap between the axially inner face of groove and the circumferential seal and from there under the circumferential seal. This high pressure gas sitting in a L shaped clearance volume formed between the circumferential groove and the circumferential seal is free to fill the entire circumference of this L shaped clearance volume. The high pressure gas in this L shaped clearance volume is free to exit axially inward at all positions around the circumference circumferentially outboard of the two axial extending seals that straddle the window. No matter how much care is made to make the clearance between the circumferential seal and its groove small the leakage areas are huge due to the long circumferential periphery outside the axial extending seals. Worse still the high pressure gas forced under the axial extending seals is able to discharge directly into the L shaped clearance volume. The high pressure combustion gases in this L shaped clearance volume will discharge into the ports. A similar problem was encountered on earlier axial flow rotary valve arrangements and this was addressed in U.S. Pat. No. 5,526,780 (Wallis). Furthermore, gas in the ports will be able to leak between the ports using the same mechanism.

Secondly, housing the axial extending seals in the rotary valve unnecessarily increases the diameter of the valve. The valve diameter is a critical issue on rotary valve engines as it is a dominant determinant as to where the spark plug can be positioned. The larger the valve diameter the further the plug must be placed from the theoretical optimum position in the centre of the cylinder. The engine of U.S. Pat. No. 5,941,206 (Smith et al) clearly demonstrates this problem. It has a valve with a diameter similar to that of the cylinder bore and the spark plug is located under the valve and well away from the centre of the cylinder. This arrangement is acceptable for a multicylinder engine, as the valve is parallel to the crankshaft and the spark plugs can be positioned along the outside of the engine rather than between the cylinders. However, it would have no application on an axial flow rotary valve of the present invention where there is a single valve per cylinder and the axis of the valve is generally perpendicular to the crankshaft axis. In these arrangements the spark plug has to be located between the cylinders.

Thirdly, the axial seals rotate with the valve and relative to a stationary window. Consequently the distance of the seals from the sides of the window varies as the valve rotates. Whenever the seals are not immediately adjacent the window there will be excessive crevice volume that will adversely affect performance and fuel efficiency. The crevice volume issues are addressed in U.S. Pat. No. 5,526,780 (Wallis). Furthermore some of the axial extending seals must pass through the combustion chamber during the combustion process exposing the seal to unnecessarily high temperatures and heat flows.

Finally, as the axial seals rotate with the valve they seal and rub against the cylinder head bore. Consequently the cylinder head bore must be hard to prevent wear and scuffing. This clearly limits the types of material that the head can be made from. Cylinder heads are most commonly made from aluminium. If this material was used it would have to be hard coated adding to expense and complication. Alternatively as disclosed in U.S. Pat. No. 5,941,206 (Smith et al) an additional sleeve must be fitted to the head increasing the complexity and cost.

The present invention seeks to ameliorate one or more of the disadvantages associated with the abovementioned prior art.

SUMMARY OF INVENTION

The present invention consists of a rotary valve assembly for an internal combustion engine comprising a valve having a cylindrical centre portion, an inlet port and an exhaust port terminating respectively as an inlet opening and an exhaust opening in the periphery of said centre portion, a cylinder head having a bore in which said valve rotates about an axis with a predetermined clearance between said bore and said centre portion, a window in said bore communicating with a combustion chamber, said openings periodically communicating with said window as said valve rotates about said axis, first and second floating elongate axial seals substantially parallel with said axis and adjacent opposite sides of said window, each located in a slot in said bore and biased against said centre portion, characterised in that, at least one floating elongate axial masking seal is located in a blind ended slot in said bore and biased against said centre portion, said masking seal being disposed substantially parallel to said axis, circumferentially outside said window and circumferentially remote from each of said first and second axial seals, the axial extremities of said inlet and exhaust openings being axially between the ends of said masking seal.

Preferably said rotary valve assembly further comprises first and second circumferential seals disposed axially outside opposite ends of said window, each said circumferential seal extending circumferentially around said valve at least past said masking seal, said masking seal being disposed axially between said first and second circumferential seals. Preferably, each said circumferential seal extends circumferentially around said valve at least from said first axial seal to said second axial seal.

In one preferred embodiment, said first and second circumferential seals are annular sealing rings. Preferably said first and second circumferential seals are biased axially inwards against first and second radial faces, respectively, extending radially inwards from opposite ends of said centre portion.

In another preferred embodiment, said first and second circumferential seals are inner circumferential sealing elements.

BEST MODE OF CARRYING OUT THE INVENTION

Figure 1:
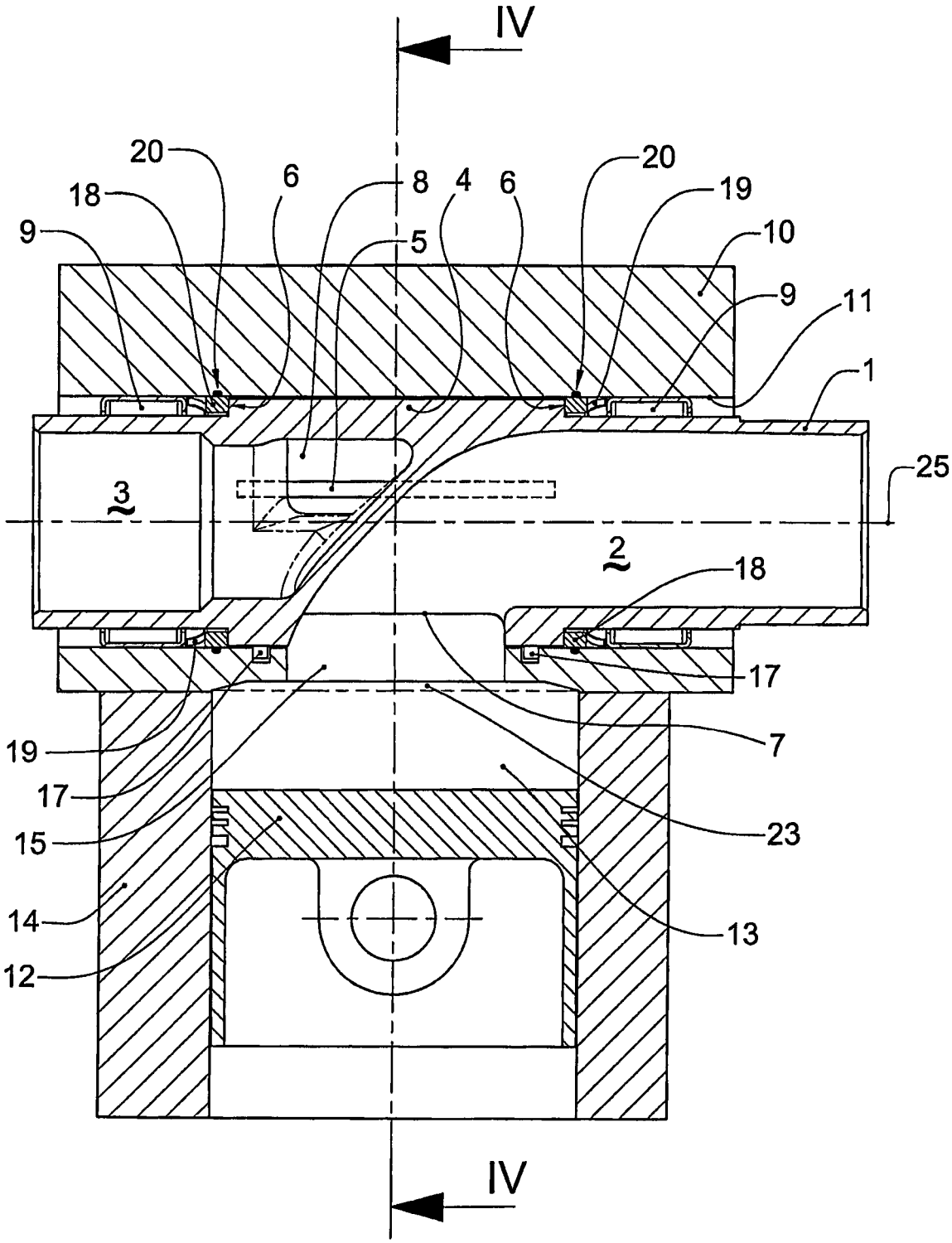
FIG. 1 is a cross sectional view of an internal combustion engine with a first embodiment of a rotary valve assembly in accordance with the present invention.

FIG. 1 depicts a rotary valve engine assembly comprising a valve 1 and a cylinder head 10. Valve 1 has an inlet port 2 and an exhaust port 3. Valve 1 has a cylindrical centre portion 4. Inlet port 2 terminates at inlet opening 7 in the periphery of centre portion 4. Exhaust port 3 terminates at exhaust opening 8 in the periphery of centre portion 4. Exhaust opening 8 axially overlaps inlet opening 7 and is circumferentially offset to inlet opening 7. Valve 1 is supported by bearings 9 to rotate about axis 25 in cylinder head 10. Bearings 9 allow valve 1 to rotate about axis 25 whilst maintaining a small running clearance between centre portion 4 and bore 11 of cylinder head 10.

The centre portion 4 of valve 1 extends axially a small distance past the axial extremities of an array of floating seals that perform the gas sealing function. Valve 1 steps radially inward either side of centre portion 4 forming a radial face. These radial faces forms valve seats 6 against which valve sealing rings 18 are preloaded by face seal springs 19. Valve sealing rings 18 are annular in shape and are slidingly sealed to bore 11 by means of o-rings 20. The combination of valve seats 6, valve sealing rings 18, o-rings 20 and face seal springs 19 create a face seal arrangement that prevents leakage of oil from bearings 9 into the clearance between the periphery of centre portion 4 and bore 11. Masking seal 5 is housed in blind ended slot 24 (refer FIG. 2) in bore 11 of cylinder head 10.

Cylinder head 10 is mounted on the top of cylinder block 14. Piston 12 reciprocates in cylinder 13 formed in cylinder block 14. As valve 1 rotates, inlet opening 7 and exhaust opening 8 periodically communicate with window 15 in cylinder head 10, allowing the passage of fluids between combustion chamber 23 and valve 1.

Figure 2:
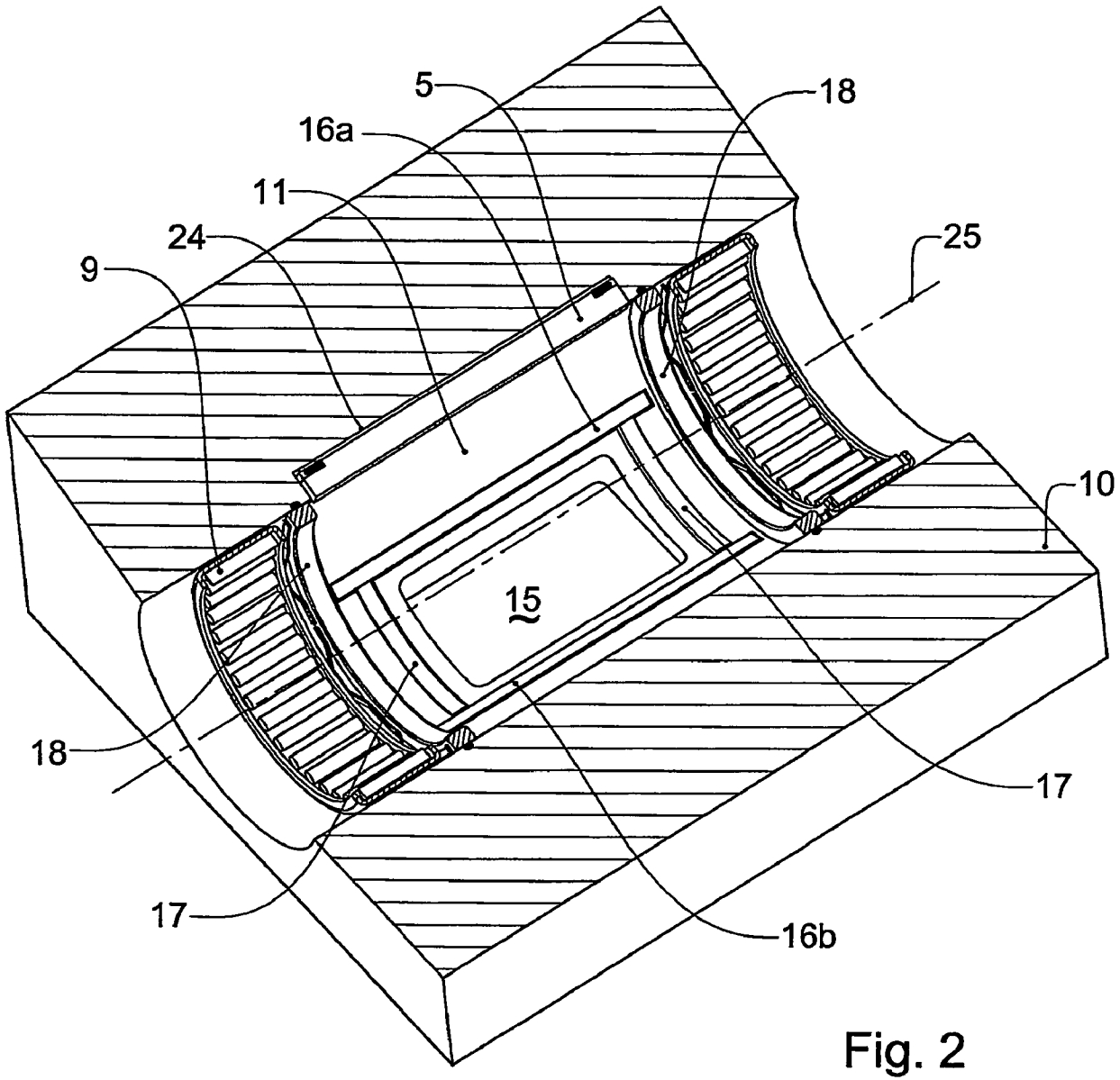
FIG. 2 is an isometric of cross-sectional view II-II of FIG. 4 showing the array of axial and circumferential seals, a masking seal and valve sealing rings. For clarity, all rotary valve components apart from the seal array, the masking seal, valve sealing rings, bearings and face seal springs are removed.

FIG. 2 shows an array of floating seals, surrounding window 15, comprising leading axial seal 16*a*, trailing axial seal 16*b* and circumferential seals 17 housed in slots in cylinder head 10. Window 15 is rectangular. Axial seals 16*a*, 16*b* are substantially parallel with axis 25 and are spaced apart on opposite sides of window 15. Circumferential seals 17 are located in respective planes substantially perpendicular to axis 25 and spaced apart on opposite ends of window 15. Axial seals 16*a*, 16*b* and circumferential seals 17 are biased against centre portion 4. During the compression and combustion strokes the air/fuel mixture and high pressure combustion gases in combustion chamber 23 are prevented from escaping through the small running clearance that exists between the periphery of centre portion 4 and bore 11 of cylinder head 10 by axial seals 16*a*, 16*b* (in the circumferential direction) and circumferential seals 17 (in the axial direction). Valve sealing rings 18 are located a small distance axially outboard of the ends of axial seals 16*a*, 16*b*.

The array of floating seals 16*a*, 16*b*, 17 and the valve sealing rings 18 are similar to those disclosed in WO 2006/024081 A1 (Bishop Innovation Limited).

Masking seal 5 extends axially with a small clearance between the axially inner faces of valve sealing rings 18. Masking seal 5 is biased against the periphery of centre portion 4. Masking seal 5 performs its prime sealing function, when it is in contact with bridge 27 (refer to FIG. 4). Bridge 27 is that portion of the periphery of centre portion 4 spanning between inlet port 2 and exhaust port 3. Masking seal 5 is located circumferentially remote from axial seals 16*a*, 16*b*.

Figure 4:
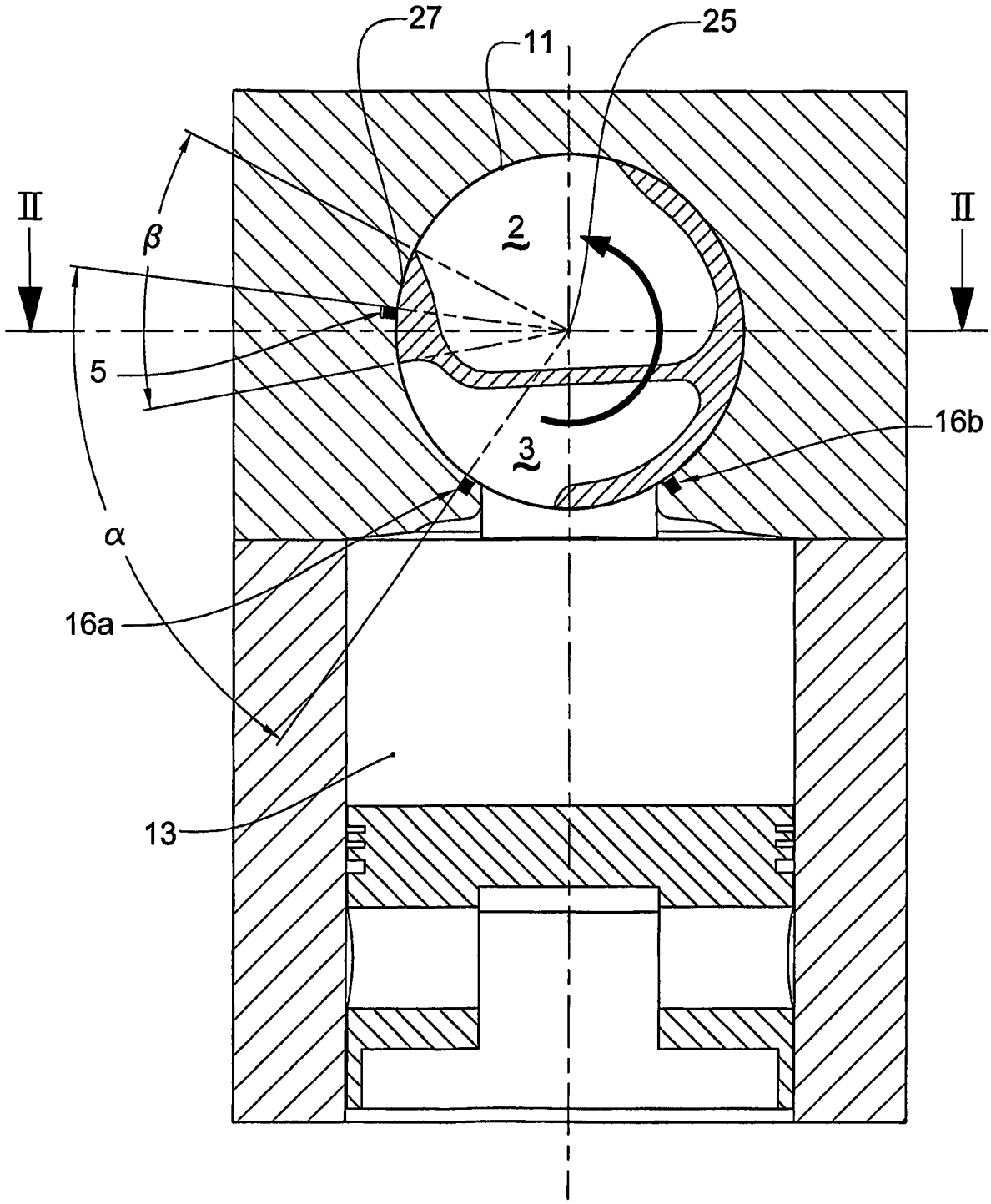
FIG. 4 is a cross sectional view in direction IV-IV of FIG. 1.

In this application circumferentially remote is defined as follows. Referring to FIG. 4, when the angle a measured about valve axis 25 between the circumferentially outer edge of leading axial seal 16*a* and the circumferentially outer edge of masking seal 5 is greater than 0.9 times the minimum angle $\beta$ between adjacent port edges that form bridge 27 on valve 1 then masking seal 5 is said to be circumferentially remote from axial seal 16*a*.

If masking seal 5 was located closer than $0.9\beta$ then both axial seal 16*a* and masking seal 5 would be contacting bridge 27 at the same time. As only one seal is required to prevent flow across the bridge, a spacing closer than $0.9\beta$ means that more masking seals are being used than are functionally required. This also has adverse cost and parts count penalties.

Figure 3:
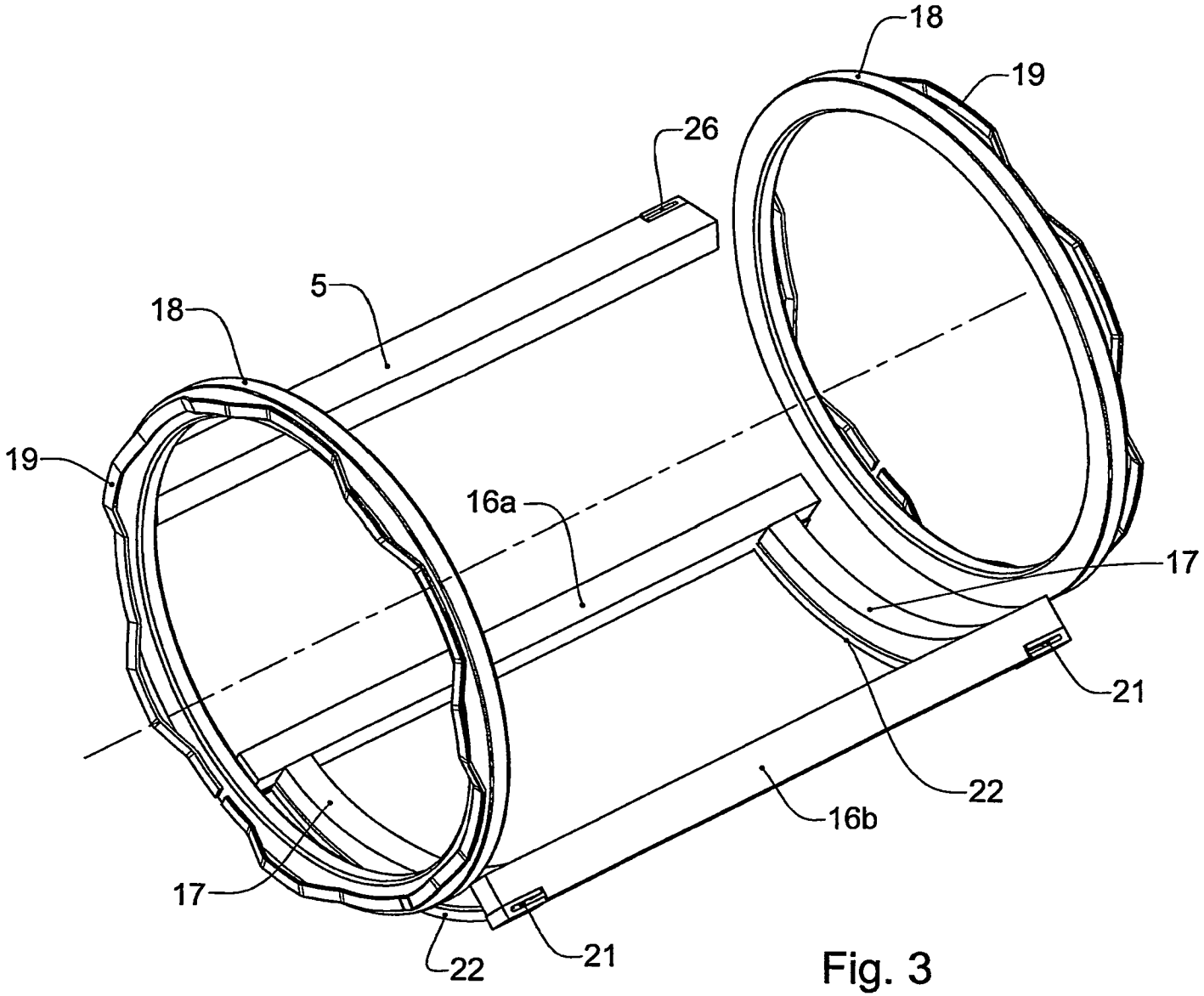
FIG. 3 is a schematic view of the gas seal array, the masking seal and valve sealing rings of the engine of FIG. 1 arranged in their working position.

FIG. 3 is a schematic of the array of sealing elements showing the various sealing elements positioned relative to one another in space. Axial seals 16*a*, 16*b* are biased against centre portion 4 of valve 1 by springs 21 at each end of each axial seal 16*a*, 16*b*. Masking seal 5 is biased against centre portion 4 of valve 1 by springs 26. Valve sealing rings 18 are biased against valve seat 6 by face seal springs 19 and are located adjacent the ends of axial seals 16*a*, 16*b* and masking seal 5. There is a small axial clearance between the axially inner faces of valve sealing rings 18 and the ends of axial seals 16*a*, 16*b* and masking seal 5. Circumferential seals 17 are biased against centre portion 4 of valve 1 by means of springs 22.

FIG. 4 shows a cross section through the centre of cylinder 13 perpendicular to axis 25 of valve 1 early in the exhaust stroke. The high pressure gas in cylinder 13 is discharging into exhaust port 3 where the pressure rises rapidly. Masking seal 5 is preloaded against bridge 27. Masking seal 5 is positioned circumferentially in cylinder head bore 11 such that during that portion of the exhaust stroke where the pressure in exhaust port 3 is high masking seal 5 bears against bridge 27. In this valve position, masking seal 5 prevents circumferential leakage of exhaust from exhaust port 3 into inlet port 2. A very small volume of exhaust gas may leak from exhaust port 3 to inlet port 2 between the ends of masking seal 5 and adjacent valve sealing ring 18.

It is clear that masking seal 5 is only effective during that portion of the cycle where masking seal 5 is in contact with bridge 27. In the event the pressure in exhaust port 3 remained high after valve 1 has rotated to a position where bridge 27 was no longer in contact with masking seal 5 and it was desired to prevent the exhaust leaking into inlet port 2, then an additional masking seal 5 would need to be added to the assembly offset to existing masking seal 5 in the direction of rotation of valve 1.

In the arrangement shown in FIG. 4, masking seal 5 is not required to prevent unintended leakage across bridge 27 whilst ever bridge 27 is in contact with either leading axial seal 16*a* or trailing axial seal 16*b*, or when bridge 27 is located between axial seals 16*a* and 16*b*. This situation occurs over approximately 30% of the cycle time. Consequently, in an arrangement without masking seals unintended leakage between the ports can occur over approximately 70% of the cycle time. The presence of a single masking seal 5 will reduce this time by approximately 11% of the cycle time, which is the percentage of the cycle time where bridge 27 is in contact with masking seal 5. In production engines having a wider bridge (ie. angle β is larger) this reduction may be as high a 15% of the cycle time (ie. the proportion of the cycle time when unintended leakage can occur is reduced to 55%).

If in a particular engine design, the leakage between the exhaust port and the inlet port is too great when the engine is operating at a low speed idle then the leakage can be further reduced by simply adding additional masking seals to reduce the proportion of the cycle time available for leakage. In a typical production engine with one masking seal, unintended leakage can occur over approximately 55% of the cycle time, as discussed above. If the engine has two masking seals this will reduce to approximately 40% of the cycle time, and if the engine has three masking seals this will further reduce to 25%. Generally two masking seals will be adequate to reduce the leakage to an acceptable level. When masking seals are added for the purpose of controlling leakage at idle it is desirable that they are positioned such that they have the greatest effect in controlling leakage flow across the bridge at full throttle, which is when there is the maximum pressure drop between the ports.

It is clear that if several masking seals were positioned around cylinder head bore 11 such that bridge 27 was always in contact with one of masking seals 5 there would be no leakage between ports 2, 3 (apart from the minor leakage that occurs around the end of masking seals 5). However this solution would needlessly use excessive numbers of masking seals 5 pushing up the cost and increasing the friction losses associated with the valve assembly. Masking seals 5 are therefore only located where there is a high pressure drop between ports 2, 3 and where the resulting gas flow has a negative impact on the operation of the engine. On most engines there is typically only a requirement for one or two masking seals 5.

Figure 5:
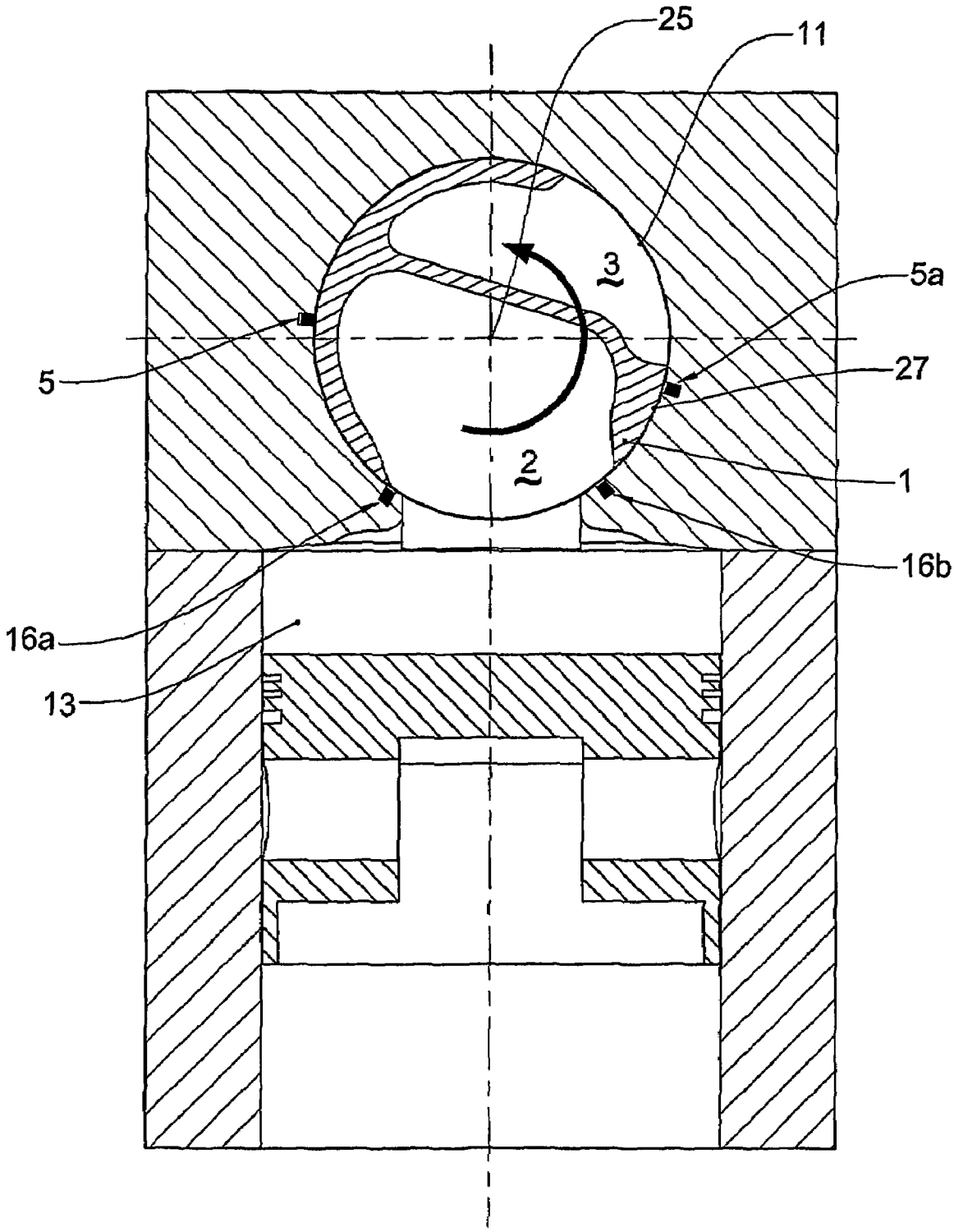
FIG. 5 shows a second embodiment of a rotary valve assembly in accordance with the present invention. It is the same cross-sectional view as in FIG. 4 except the engine is positioned in the induction stroke.

FIG. 5 shows a second embodiment of the present invention where there are two masking seals 5 and 5*a*. The engine is shown during the induction stroke. During the early part of the induction stroke pressure in cylinder 13 is pulled below atmospheric pressure. In some engines, particularly high performance engines an exhaust wave will increase the pressure in exhaust port 3 well above atmospheric pressure at this point in the engine cycle. Masking seal 5*a* prevents exhaust gas being pushed into cylinder 13 through inlet port 2.

Figure 6:
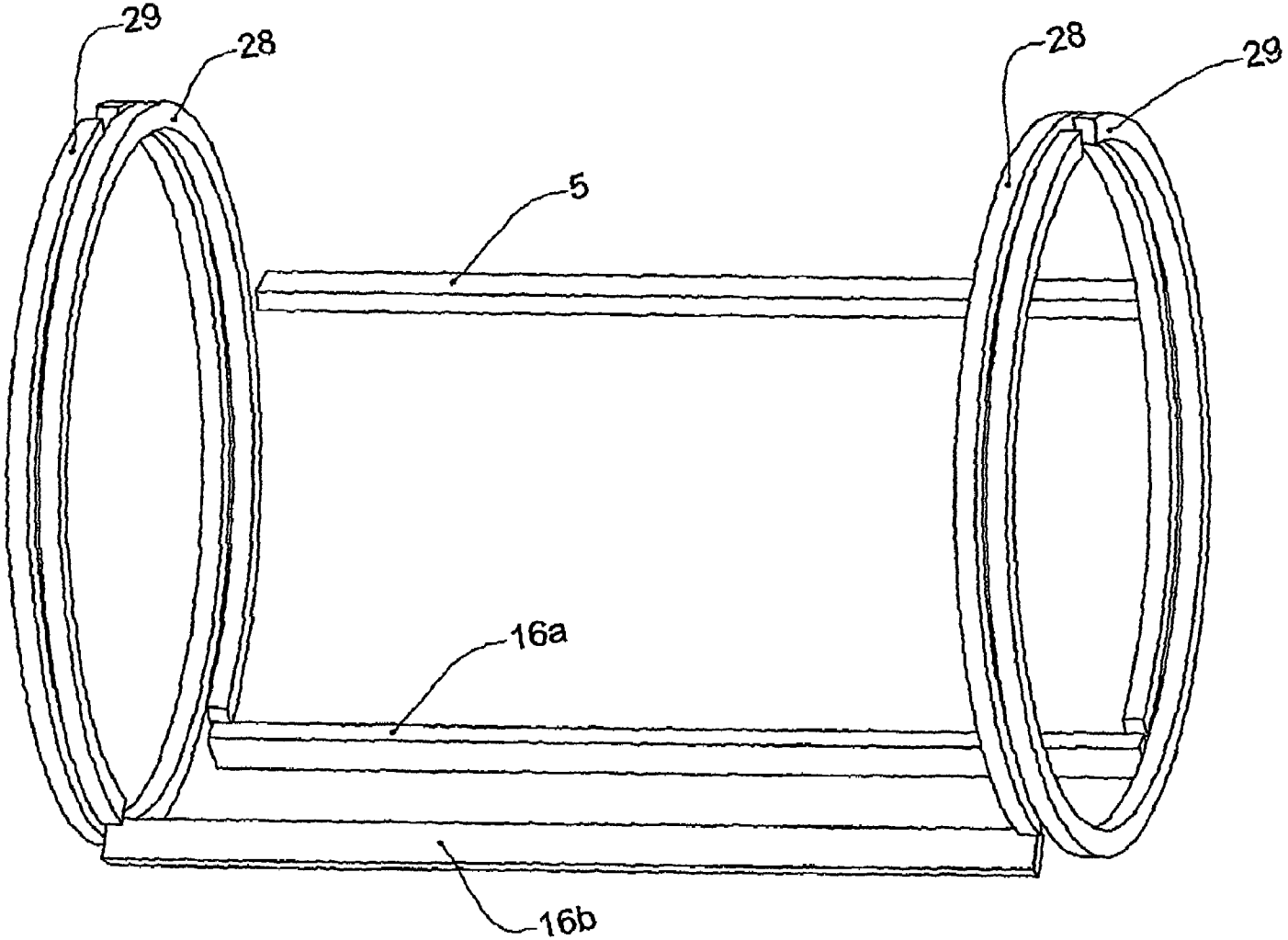
FIG. 6 is a schematic view of the gas seal array and masking seal of a third embodiment of a rotary valve assembly in accordance with the present invention where the gas seal array is similar to that disclosed in U.S. Pat. No. 5,526,780 (Wallis).

FIG. 6 shows a third embodiment of the present invention. It is a schematic layout of an array of floating seals similar to that disclosed in U.S. Pat. No. 5,526,780 (Wallis) with a masking seal 5. The array of floating seals comprises axial seals 16*a*, 16*b*, inner circumferential sealing elements 28 and outer circumferential sealing elements 29. Masking seal 5 spans, with small clearance, axially between the inner faces of inner circumferential sealing elements 28. Masking seal 5 and inner circumferential sealing element 28 act in the same manner as masking seal 5 and valve sealing ring 18 in the first embodiment described above.

The term "comprising" as used herein is used in the inclusive sense of "including" or "having" and not in the exclusive sense of "consisting only of".

The invention claimed is:

1. A rotary valve assembly for an internal combustion engine comprising:

a valve having a cylindrical center portion, an inlet port and an exhaust port terminating respectively as an inlet opening and an exhaust opening in the periphery of said center portion, a cylinder head having a bore in which said valve rotates about an axis with a predetermined clearance between said bore and said center portion, said center portion having a bridge spanning between said inlet opening and said exhaust opening, a window in said bore communicating with a combustion chamber, said inlet opening and said exhaust opening periodically communicating with said window as said valve rotates about said axis, first and second floating elongate axial seals substantially parallel with said axis and adjacent opposite sides of said window, each located in a slot in said bore and biased against said center portion, and at least one floating elongate axial masking seal is located in a blind ended slot in said bore and biased against said center portion, said masking seal being disposed substantially parallel to said axis, circumferentially outside said window and circumferentially remote from each of said first and second axial seals, the axial extremities of said inlet and exhaust openings being axially between the ends of said masking seal, wherein said masking seal is in contact with said bridge during at least one portion of a cycle where a pressure gradient across said bridge is high and a resulting leakage across said bridge significantly adversely affects performance of said internal combustion engine.

2. A rotary valve assembly as claimed in claim 1 further comprising first and second circumferential seals disposed axially outside opposite ends of said window, each said circumferential seal extending circumferentially around said valve at least past said masking seal, said masking seal being disposed axially between said first and second circumferential seals.

3. A rotary valve assembly as claimed in claim 2 wherein each said circumferential seal extends circumferentially around said valve at least from said first axial seal to said second axial seal.

4. A rotary valve assembly as claimed in claim 3 wherein said first and second circumferential seals are annular sealing rings.

5. A rotary valve assembly as claimed in claim 4 wherein said first and second circumferential seals are biased axially inwards against first and second radial faces, respectively, extending radially inwards from opposite ends of said center portion.

6. A rotary valve assembly as claimed in claim 3 wherein said first and second circumferential seals are inner circumferential sealing elements.

7. A rotary valve assembly as claimed in claim 1 wherein said at least one masking seal comprises a maximum of two masking seals.

8. A rotary valve assembly as claimed in claim 1 wherein said at least one masking seal comprises one masking seal only.

9. A rotary valve assembly as claimed in claim 1 wherein said first and second axial seals are part of an array of floating seals that surround said window, said array of floating seals further comprising first and second arcuate circumferential seals disposed in slots in said bore, axially outside opposite ends of said window, said arcuate circumferential seals being disposed axially between the ends of said first and second axial seals.

10. A rotary valve assembly as claimed in claim 9 wherein said rotary valve assembly further comprises first and second sealing rings located axially outside of said first and second axial seals, said masking seal extending axially with a small clearance between the inner faces of said sealing rings.

11. A rotary valve assembly as claimed in claim 1 wherein said at least one portion of the cycle occurs early in an exhaust stroke where pressure in the exhaust port is high.

* * * * *